US006558752B2

(12) United States Patent
Bellemare et al.

(10) Patent No.: US 6,558,752 B2
(45) Date of Patent: May 6, 2003

(54) ELECTROSTATIC FLUIDIZED BED COATING METHOD AND APPARATUS

(75) Inventors: David J. Bellemare, Durham, CT (US); John Donahue, New Haven, CT (US); Martin Fagan, Northford, CT (US); Robert Vollono, Branford, CT (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/209,491

(22) Filed: Jul. 30, 2002

(65) Prior Publication Data

US 2002/0187258 A1 Dec. 12, 2002

Related U.S. Application Data

(62) Division of application No. 09/578,171, filed on May 24, 2002, now Pat. No. 6,458,210.

(51) Int. Cl.[7] ..... B05D 1/06; B05D 1/22

(52) U.S. Cl. ..... 427/459; 427/460; 427/475; 427/185

(58) Field of Search ..... 427/458–461, 427/475, 485, 486, 185; 118/DIG. 5, 421, 429

(56) References Cited

U.S. PATENT DOCUMENTS 3,496,413 A 2/1970 Goodridge et al. ..... 317/3
3,590,776 A * 7/1971 Tudor et al.
3,649,326 A * 3/1972 Cole et al.
3,901,180 A * 8/1975 Allen et al.
3,901,185 A 8/1975 Goodridge et al. ..... 118/630
4,053,661 A 10/1977 Goodridge ..... 118/DIG. 5
4,101,687 A * 7/1978 Knudsen
5,212,847 A 5/1993 Melcher et al. ..... 15/244.1
5,242,718 A 9/1993 Gillette et al. ..... 427/459
5,470,615 A * 11/1995 Sbalchiero et al.
5,518,546 A * 5/1996 Williams et al.

* cited by examiner

*Primary Examiner*—Fred J. Parker
(74) *Attorney, Agent, or Firm*—Wood, Herron & Evans, L.L.P.

(57) ABSTRACT

Method for applying powder to objects, such as electric motor stators and permeable substrates. The apparatus includes a first chamber having upper and lower portions. A powder fluidizing bed is disposed at the lower portion and receives and fluidizes a bed of powder to form a powder cloud within the first chamber. An opening is disposed at the upper portion of the first chamber and directs at least one stream of the powder from the powder cloud out of the first chamber. An object holder is disposed above the opening and is configured to hold at least one of the objects at a position for intersecting the stream of powder.

9 Claims, 4 Drawing Sheets

ELECTROSTATIC FLUIDIZED BED COATING METHOD AND APPARATUS

This application is a divisional of application Ser. No. 09/578,171, filed May 24, 2002 U.S. Pat. No. 6,458,210, the disclosure of which is fully incorporated herein by reference.

FIELD OF THE INVENTION

The present invention generally relates to apparatus and methods for applying powder to objects. More specifically, the invention relates to electrostatic and other powder application apparatus and methods.

BACKGROUND OF THE INVENTION

Powder coating technology has generally evolved over several years into several different coating techniques performed with various types of coating systems. Generally, a powder, such as a resinous polymer or paint, is initially adhered to an electrically conductive object. This initial coating process typically involves electrically grounding the object and electrostatically charging the powder particles such that the electrostatic attraction causes the powder to adhere to the object ideally, in most applications, with a uniform coating thickness. This initial powder coating is then cured using heat or other techniques, such as infrared or ultraviolet light. This fully adheres the coating to the object.

Applying powder to internal portions of certain objects presents unique problems. For example, electric motor stators are often shaped cylindrically with inwardly facing slots configured to receive copper windings. There must be an electrically insulating layer between the copper windings and the metal defining the slots of the stator. Therefore, when powder coating techniques are used to provide a layer of insulation on these metal surfaces, the powder must penetrate into the slots of the stator, preferably without saturating the end faces of the stator with powder. Especially when faced with stators having deep slots, it has been difficult to fully penetrate into these slots and provide uniform coatings on the internal stator surfaces. Powder spray guns have been attempted in these situations, but generally impart too much powder velocity and, therefore, blow too much powder out from the slots. On the other hand, parts have been placed in the powder cloud formed by electrostatic fluidized beds. However, this may not provide a uniform coating to internal portions of a part for opposite reasons. That is, in conventional forms electrostatic fluidized bed coaters form a powder cloud within a chamber, but this powder cloud generally moves with very low velocity. For this reason, the powder deposits at the end faces of the stators, but does not penetrate fully into the slots.

For the reasons stated above, as well as other reasons, it would be desirable to provide powder application techniques and apparatus which can more uniformly and effectively coat internal portions of an object, such as a motor stator or other object requiring internal penetration of an object with a more uniform application of powder than provided with past apparatus and techniques.

SUMMARY OF THE INVENTION

The present invention generally provides apparatus for applying powder to objects including a first chamber having first and second portions. A powder fluidizing bed is disposed at the first portion of the first chamber and fluidizes a bed of powder to form a powder cloud in the first chamber and moving generally toward the second portion. An opening is disposed at the second portion of the first chamber and directs at least one stream of the powder from the powder cloud out of the first chamber. An object holder is disposed outside the chamber and is configured to hold at least one of the objects at a position for intersecting the stream of powder. In general, the apparatus provides a flow of powder from the chamber which is directed at a greater velocity than the typical velocity of powder within a fluidized bed coating chamber, but less than the velocity from a typical powder spray gun. This allows internal portions of an object, such as a motor stator, to be coated uniformly by forcing the powder through the slots of the stator, or other internal portions of an object, without forcing the powder at such a speed that it will not adhere to the object surfaces due, for example, to electrostatic attraction between the powder and the object.

The apparatus more specifically includes a porous member disposed at a lower portion of the first chamber below the bed of powder. The opening is disposed at an upper portion of the first chamber and having an upper side facing the bed of powder and an opposite lower side. An electrostatic charging device is positioned in an air flow path leading to the lower side of the porous member. A pressurized air inlet directs pressurized air into the air flow path such that the air is charged by the electrostatic charging device and then passes respectively through the lower and upper sides of the porous member and into the bed of powder. The apparatus includes a second chamber having an object inlet and an object outlet. The object holder is positioned in the second chamber and is movable to deliver the object from the object inlet to the object outlet. The object holder preferably includes an arm which rotates to move the object from the object inlet to the object outlet. More preferably, and especially in the case of coating motor stators, the arm extends into the second chamber along an axis and the arm further rotates about that axis to rotate the object within the stream of powder and expose multiple sides of the object to the stream of powder. This can facilitate more uniform penetration of powder into the object, such as into the slots of a motor stator.

As another feature of the preferred apparatus, the opening is adjustable in size to vary physical characteristics of the stream of powder. For example, the velocity and/or the amount of powder in the powder stream may be varied by reducing or increasing the size of the opening in the upper portion of the first chamber. The opening is formed generally at the narrowest region of a converging area inside the first chamber. This, for example, may be accomplished by using a plurality of converging plates which have upper ends generally forming an apex and the opening. At least one of the converging plates is movable with respect to the other to adjust the size of the opening. A height adjustment mechanism may also be coupled with either the first chamber or the object holder, or both, for adjusting the distance between the opening and the object holder. This feature can be helpful to adjust the amount of powder penetration into the object and to adjust for smaller or larger objects being coated or otherwise applied with powder using the same apparatus. As another alternative feature, the opening may further comprise a plurality of separate channels for directing a plurality of separate streams of powder out of the first chamber to thereby increase the velocity of the powder prior to contacting the object. This has been found especially useful when impregnating objects, such as nonwoven substrates, with a powder for various reasons.

A method performed in accordance with the inventive principles generally involves forming a powder cloud within a chamber having first portion with a constricted opening and a second portion; moving the powder cloud generally toward the constricted opening within the chamber; directing a stream of the powder through the constricted opening; and holding the object adjacent the opening and in contact with the stream of powder. As generally discussed in connection with the apparatus described above, the powder cloud is preferably formed and moved by introducing pressurized air through a bed of powder at the lower portion of the chamber and the powder is preferably electrostatically charged, while the object is charged in an opposite manner, such as by electrically grounding the object. In accordance with the preferred method, the object is a motor stator having internal and external portions and the method involves directing the stream of powder through the internal portion and over the external portion of the motor stator to coat the internal and external portions thereof with powder. In accordance with another illustrative example, the object may be a permeable object such as a nonwoven substrate, and the object may be impregnated with powder while holding the object in contact with the stream of powder.

These and other features, objects and advantages of the invention will become more readily apparent to those of ordinary skill in the art upon review of the following detailed description of the preferred embodiments, taken in conjunction with the accompanying drawings.

DETAILED DESCRIPTION OF DRAWINGS

DETAILED DESCRIPTION OF PREFERRED EMBODIMENTS

Figure 1:
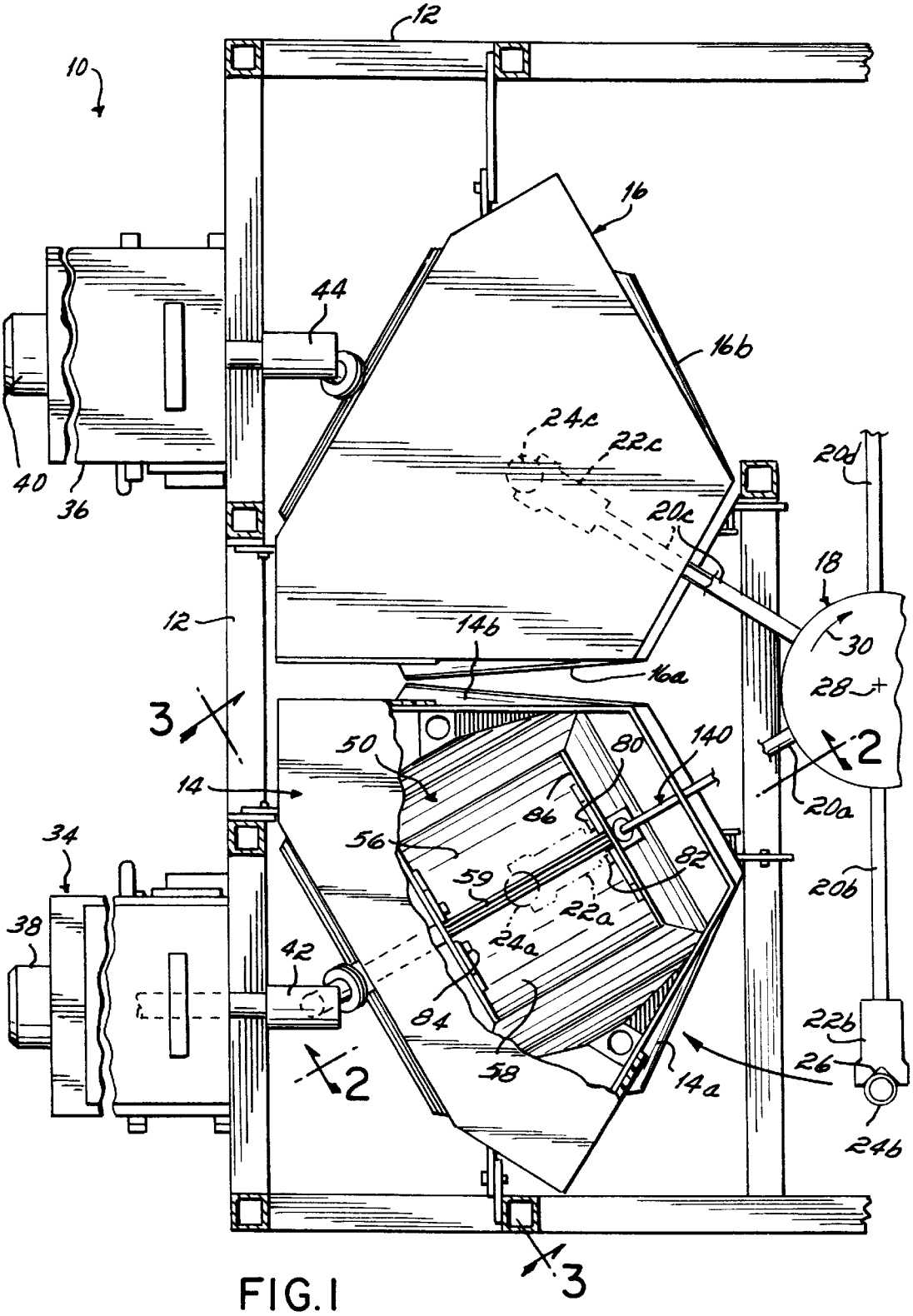
FIG. 1 is a partially fragmented top view illustrating a preferred coating apparatus constructed in accordance with the invention.
Figure 1A:
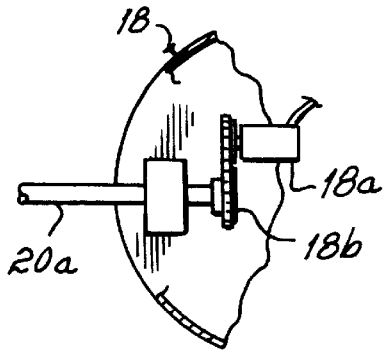
FIG. 1A is a fragmentary cross section view of the indexing mechanism.
Figure 2:
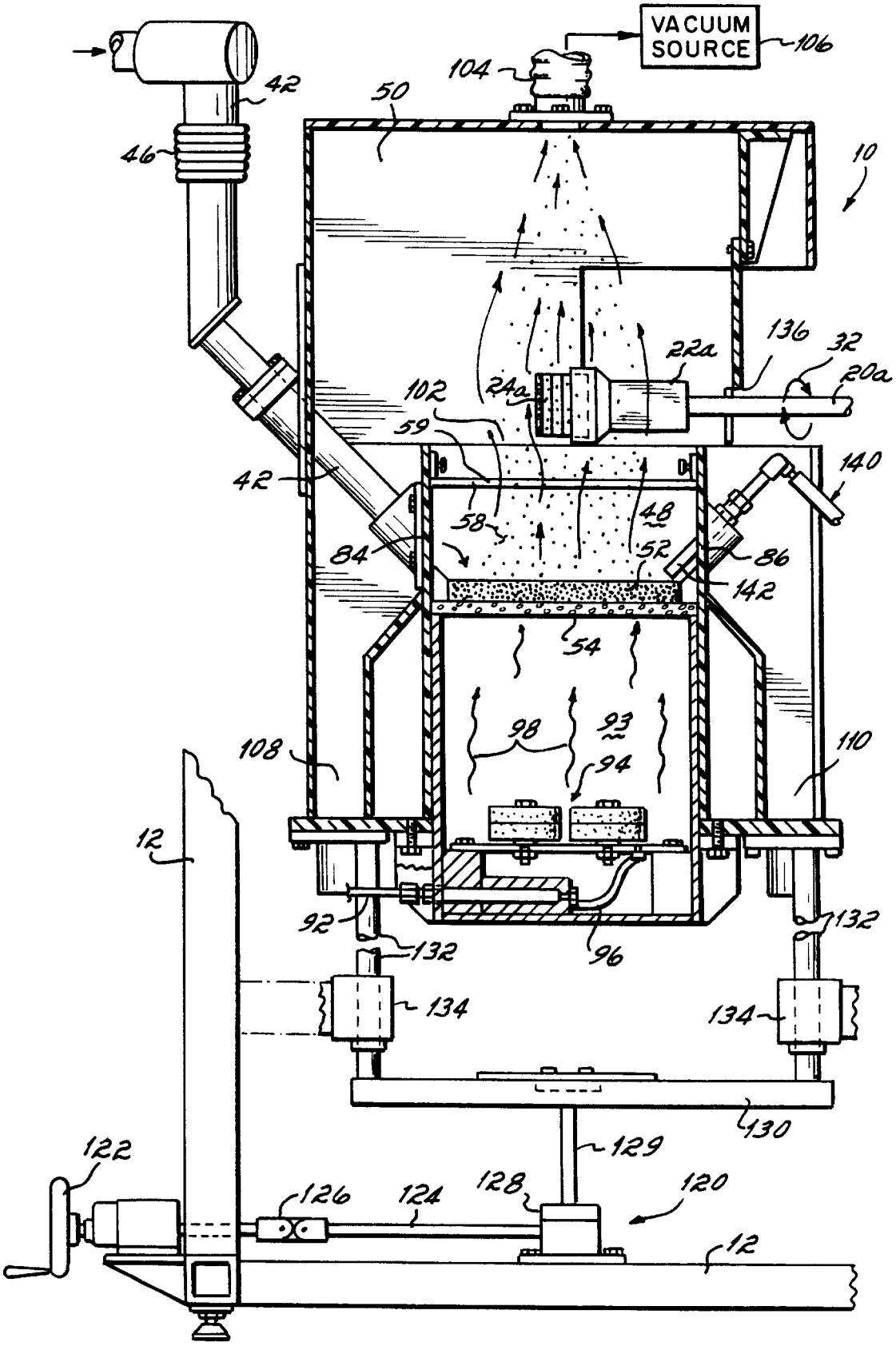
FIG. 2 is a cross sectional view generally taken along line 2—2 of FIG. 1.
Figure 3:
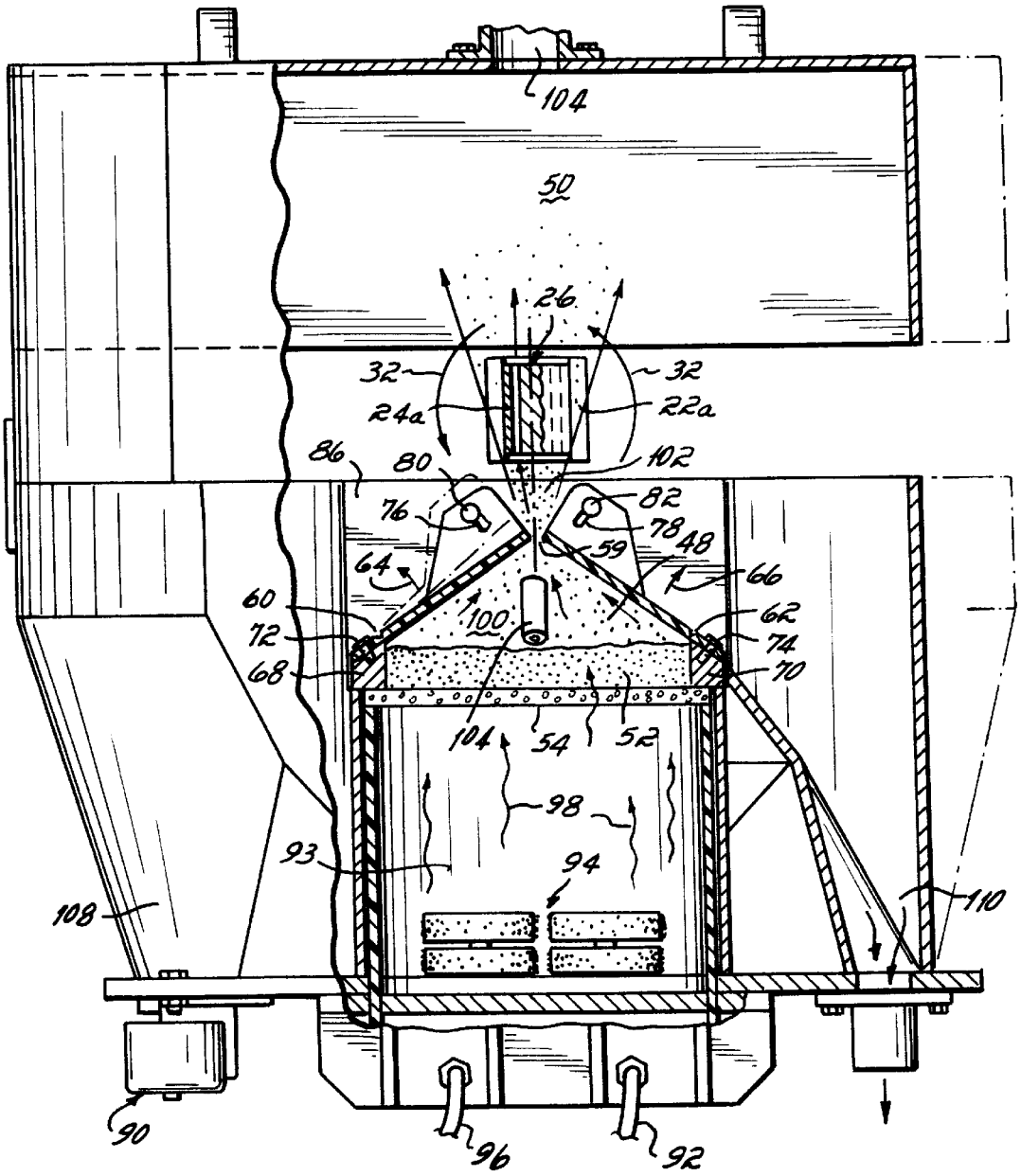
FIG. 3 is a cross sectional view generally taken along line 3—3 of FIG. 1.

Referring first to FIGS. 1–3, a preferred embodiment of the invention is shown in the form of a coating apparatus 10. Coating apparatus 10 includes a stationary frame structure 12 for supporting first and second coating structures 14, 16. Although two coating structures 14, 16 are shown herein, and are of identical construction, only one coating structure may be necessary for certain applications, or more coating structures may be necessary for other applications. Only the details of coating structure 14 are shown and described herein with the understanding that the details of coating structure 16 are the same. A rotatable indexing mechanism 18 is provided having a plurality of arms 20*a*, 20*b*, 20*c*, 20*d* extending radially therefrom. Apparatus 10 preferably includes six arms, however, more or less arms may be provided as necessitated by the application. Each arm includes a part holder 22*a*–*d* at an outer end thereof for holding respective parts, shown as motor stators 24*a*, 24*b*, 24*c* in FIGS. 1–3. Part holders 22*a*–*c* include a v-notch 26 for receiving the parts, as shown with respect to part 24*b*. Part holders 22*a*–*d* preferably include permanent magnets (not shown) which hold the ferrous metal stators 24*a*–*c* in place during a powder coating operation. Indexing mechanism 18 rotates about an axis 28 in the direction of arrow 30 such that arms and part holders 20*a*–*d*, 22*a*–*c* rotate through inlet 14*a* of coating structure 14 out the outlet 14*b*, into inlet 16*a* and, finally, out the outlet 16*b* of coating structure 16. Indexing mechanism preferably stops each part 24*a*–*c* within each coating structure 14, 16 at the positions shown to allow coating to take place as described below. In this embodiment, parts 24*a*–*c* stop for 20–30 seconds within each coating structure 14, 16. Simultaneously, arms 20*a*–*d* each rotate about their own respective longitudinal axis in the direction of arrow 32 (FIG. 2) for purposes to be described below. Referring to FIG. 1A, rotation of arm 20*a*, as well as the other arms, is accomplished with an electric motor 18*a* and sprocket assembly 18*b*. Arm 20*a* is supported for rotation by one or more bearings 18*c*, as necessary. Arm 20*a* preferably rotates about its axis continuously during the coating process, but rotation may be stopped and started as necessary instead.

Respective powder feeders 34, 36 are coupled to coating structures 14, 16 and include motors 38, 40 and feed chutes 42, 44. Motors 38, 40 drive conventional screw augers for conveying powder into the respective feed chutes 42, 44. Flexible boots 46 (one shown in FIG. 2) allow for vertical movement of coating structures 14, 16 for purposes to be described below. Each feed chute 42, 44 leads into a respective first chamber 48, as shown in FIG. 2 with respect to coating structure 14. A second chamber 50 has at least a portion thereof disposed above first chamber 48. First chamber 48 includes a bed of powder 52 at a lower portion thereof which is supported on top of a porous plate 54. An upper portion of first chamber 48 includes a pair of angled plates 56, 58 which converge in an upward direction to define an opening 59 therebetween. Plates 56, 58 each are movable in a pivoting manner due to respective living hinges 60, 62 disposed at lower ends thereof. Each plate 56, 58 is generally movable in the direction of arrows 64, 66, respectively, or in opposite directions. This allows opening 59 to be varied in size and, more specifically, in width along its length. At lower ends, plates 56, 58 are securely fastened to support members 68, 70 by fasteners 72, 74. Slots 76, 78 are provided at upper ends of plates 56, 58 and allow for selective locking of plates 56, 58 at desired angular positions relative to one another by tightening fasteners 80, 82. Side walls 84, 86 disposed perpendicular to plates 56, 58 define the other two sides of first chamber 48.

A vibrator unit 90 is coupled with coating structure 14, as shown in FIG. 3, to assist in maintaining the fluidized state of powder bed 52. The main fluidization occurs due to a conventional pressurized air system including a pressurized air inlet 92 which directs pressurized air into a third chamber 93 disposed below first chamber 48 and including an electrostatic charging device 94. A high voltage line 96 (FIG. 2) is coupled to electrostatic charging device 94, which also may be of conventional design. Air traveling in the direction of arrows 98 carries the electrostatic charge through porous plate 54 and into powder bed 52 thereby electrostatically charging the powder particles forming powder cloud 100 emanating from bed 52. A stream of electrostatically charged powder 102 exits chamber 48 through opening 59 and internally and externally coats part 24*a* as shown in FIG. 3. During at least the time that part 24*a* is stopped at the position shown, part 24*a* is rotated in the manner shown by arrows 32 to expose multiple sides of part 24*a* to powder stream 102. As further shown in FIG. 2, a conduit 104 is coupled to a vacuum source 106 to suction excess powder out of second chamber 50. Any additional excess powder in second chamber 50 falls through powder collection outlets 108, 110.

As further shown in FIG. 2, a height adjustment mechanism 120 is coupled to coating structure 14 and includes a hand wheel 122 coupled with a rotatable rod 124 having a pivoting coupling 126 and coupled with a gear box 128. Gear box 128 converts rotational movement of rod 124 to vertical translational movement of member 129, which may be a drive screw. Other suitable supports (not shown) may be used to support the weight of coating structure 14. Drive screw 129 is coupled with a horizontal support 130 and horizontal support 130 is coupled with vertical supports 132 received by bushings 134. It will be appreciated that when hand wheel 122 is turned, coating structure 14 will be adjusted in height relative to part 24*a* which extends into second chamber 50 through a slot 136. A sensor 140 is provided with a sensor tip 142 disposed in an appropriate location to sense the amount of powder in bed 52 and, as needed, instruct a suitable control (not shown) to activate motor 38 to feed additional powder into first chamber 48.

Figure 4:
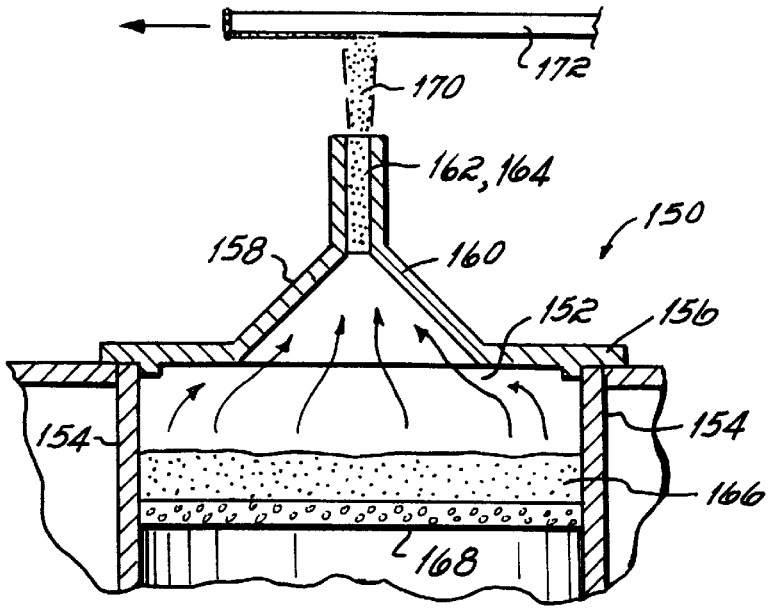
FIG. 4 is a cross sectional view of a coating apparatus similar to FIG. 3, but illustrating an alternative opening for forming a stream of powder.
Figure 5:
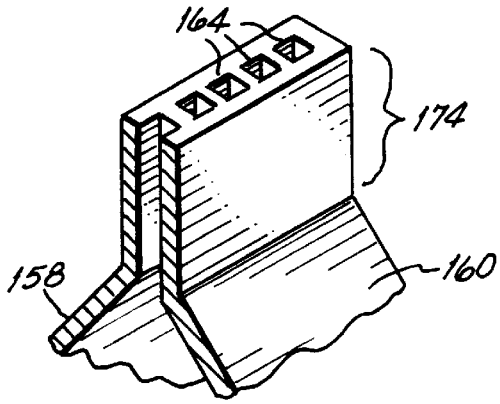
FIG. 5 is a fragmented perspective view showing the upper portion of the apparatus illustrated in FIG. 4.

Referring to FIGS. 4 and 5, an alternative coating apparatus 150 is shown and includes a first chamber 152 defined by side walls 154, a top wall 156 including converging portions 158, 160. Converging portions 158, 160 converge upwardly to an opening 162 defined by a plurality of channels 164. A bed of powder 166 resting on a porous plate 168 defines the bottom of first chamber 152. The other components necessary to create a powder cloud within chamber 152 and, if necessary, electrostatically charge the powder, may be the same as described above with regard to the first embodiment. Other structure associated with apparatus 150 may be the same as apparatus 10 or may be modified in accordance with the needs of a particular powder application needs of the object to which the powder is to be applied. A stream of powder 170 exits channels 164 and impinges upon a substrate 172. Channels 164 are contained in an elongate section 174 and preferably are of constant dimension along their length, in a vertical direction, as shown in FIG. 4. This significantly increases the velocity of stream 170. In this embodiment, substrate 172 may, for example, be a nonwoven substrate, such as a high loft fiberglass batt between about 1/16 inch thick and 3 inch thick. In one example, section 174 was 6 inches in length and 4 inches in height and achieved approximately ½ inch penetration of powder into a high loft fiberglass batt. It will be appreciated that other dimensional and geometric variations will achieve other powder flow velocities and penetrations and that air pressure within first chamber 152 can also effect the physical characteristics of powder stream 170. In general, channels 164 prevent powder stream 170 from significantly fanning out and instead cause the powder to culminate for better penetration into a part, such as permeable substrate 172. It may also be possible to compress various thicker substrates during the powder application so that better penetration is achieved and more uniform impregnation results upon decompression of the substrate.

While the present invention has been illustrated by a description of various preferred embodiments and while these embodiments has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims.

We claim:

1. A method of applying power to an object comprising:

forming a power cloud within a first chamber having a constricted opening;

moving the power cloud within the first chamber generally toward the constricted opening;

directing power from the power cloud within the first chamber through the constricted opening to form a stream of power existing the constricted opening;

moving the object through a second chamber having an interior positioned adjacent the constricted opening; and intersecting the object with the stream of power in the second chamber to coat the object with the power.

2. The method claim 1, wherein moving the power cloud further comprises moving the power cloud by introducing pressurized air through a bed of the power in fluid communication with the first chamber.

3. The method of claim 2 further comprising:

electrostatically charging the pressurized air prior to introducing the pressurized air through the bed of power; and charging the object with an opposite charge to the pressurized air.

4. The method of claim 3, wherein the object is a motor stator having internal and external portions and the method further comprises:

directing the stream of powder through the internal portion and over the external portion of the motor stator to coat the internal and external portions of the motor stator with the powder.

5. The method of claim 1, wherein the object is a permeable substrate and the method further comprises:

impregnating the substrate with power while holding the object in contact with the stream of power.

6. The method of claim 5, wherein the opening further comprises a plurality of separate channels and the method further comprises:

directing the powder through the plurality of channels to increase the velocity of the stream of powder prior to impregnating the object.

7. The method of claim 1 further comprises:

rotating the object to expose multiple sides of the object to the stream of power.

8. The method of claim 1 further comprising:

adjusting the distance between the opening and the object.

9. The method of claim 8, wherein the step of adjusting the distance further comprises:

moving the first chamber in one of an upward and downward direction relative to the object.

* * * * *

UNITED STATES PATENT AND TRADEMARK OFFICE

CERTIFICATE OF CORRECTION

PATENT NO. : 6,558,752 B2
DATED : May 6, 2003
INVENTOR(S) : David J. Bellemare et al.

It is certified that error appears in the above-identified patent and that said Letters Patent is hereby corrected as shown below:

Title page,
Item [62], change "2002" to -- 2000 --.

Column 5,
Line 46, change "$^1/_2$" to -- 1 $^1/_2$ --.

Column 6,
Lines 10, 11, 13, 17, 21, 22, 23, 24, 25, 29, 42, 43 and 52 change "power" to -- powder --.
Line 15, change "power" to -- powder -- in both.
Line 23, insert -- of -- after "method".
Line 31, after "charge" insert -- relative --.
Line 50, change "comprises" to -- comprising --.

Signed and Sealed this

Seventh Day of October, 2003

JAMES E. ROGAN
*Director of the United States Patent and Trademark Office*